United States Patent [19]

Cotey et al.

[11] 4,268,991

[45] May 26, 1981

[54] SOFT FLEXIBLE ARTICULATED DOLL

[75] Inventors: John Cotey, Haddonfield; Lee S. Volpe, Collingswood, both of N.J.

[73] Assignee: The Quaker Oats Company, Chicago, Ill.

[21] Appl. No.: 10,826

[22] Filed: Feb. 9, 1979

[51] Int. Cl.[3] ..... A63H 3/46

[52] U.S. Cl. ..... 46/163; 46/164; 46/173

[58] Field of Search ..... 46/115, 151, 161–164, 46/173; 403/90, 114, 115, 128

[56] References Cited

U.S. PATENT DOCUMENTS

| | | | |
|---|---|---|---|
| 1,913,459 | 6/1933 | Skillman et al. | 403/128 |
| 2,118,677 | 5/1938 | Lower | 46/161 |
| 2,373,963 | 4/1945 | Kallus | 46/173 |
| 3,010,223 | 11/1961 | Alderson | 46/161 X |
| 3,019,552 | 2/1962 | Schleich | 46/161 X |
| 3,267,608 | 8/1966 | Ryan | 46/161 UX |
| 3,566,535 | 3/1971 | Handler et al. | 46/161 |
| 4,055,020 | 10/1977 | Kosicki et al. | 46/161 |
| 4,188,746 | 2/1980 | Wolf | 46/164 X |

FOREIGN PATENT DOCUMENTS

| | | | |
|---|---|---|---|
| 760000 | 2/1934 | France | 403/115 |

*Primary Examiner*—William A. Cuchlinski, Jr.
*Attorney, Agent, or Firm*—Cumpston & Shaw

[57] ABSTRACT

An object of the invention is to provide a doll having a soft flexible body, and joints constructed from rigid parts for joining soft flexible appendages to a skeleton onto which the soft flexible body is mounted.

The joint comprises a ball (49,88) on one of the appendages (30,48) and skeleton (12), a socket member (58,92) on the other of the appendages and skeleton which is rotatably mounted on the ball, a projection (62,106) on one of the ball and socket member, and a slot (64,104) on the other of the ball and socket member into which the projection extends for limiting rotational movement of the appendages relative to the skeleton.

22 Claims, 7 Drawing Figures

SOFT FLEXIBLE ARTICULATED DOLL

DESCRIPTION

1. Technical Field

The invention relates generally to dolls, and more particularly to a soft flexible articulated doll having joints constructed from rigid parts for joining soft appendages to the soft body for limited rotational movement.

In doll construction, it is desirable to join soft appendages such as legs, arms and head to a doll body with hidden joints providing relatively free, loose jointed movement between the appendages and body within a limited range. It is also desirable that the doll joints be constructed of a limited number of rigid parts in an economical manner, and that the movements of the appendages be loose jointed and realistic. It is further desirable to provide a neck joint for joining the head to the body for limited floppy movement when the head is in a bowed or "heads down" position, and for a fixed orientation suitable for posing when the head is in an upward or "heads up" position.

2. Background Art

The prior art, of which U.S. Pat. No. 2,621,443 is exemplary, provides a doll in which the arms and head are attached to the body by means of a partial ball and socket connection. Resilient bands interconnect the arms and head to the body for urging them into frictional engagement with the body while allowing relative rotational movement therebetween. The doll further has a hip joint comprising an axle on the leg journaled within a sleeve on the body for pivotally connecting the leg to the body for rotation between finite stops in one plane. A disadvantage of this doll construction is that the resilient bands are twisted and stressed during rotational movement of the head and arms causing the bands to break and fail. Another disadvantage is that the ball and socket are subjected to frictional forces at all times preventing free or loose jointed movement of the head and arms.

U.S. Pat. No. 3,699,715 discloses a doll comprising a foam body, and joint means having rigid and flexible parts for joining appendages to the body for free movement within a limited range. Each joint comprises a flexible coupling member on the body, a rigid coupling member on the appendage, and detents therebetween comprising slots in the flexible coupling for receiving projections on the rigid coupling. A disadvantage of this doll construction is that excessive play exists between the coupling members reducing the accuracy and reliability of the joint means. Also, no positive stop means are provided in the hip joints to enable placing the doll in a sitting position. Still another disadvantage is that the means for securing the coupling members together, and hence the appendages directly to the body, are subject to breaking or being pulled apart.

DISCLOSURE OF THE INVENTION

In accordance with the present invention, a soft flexible articulated doll is provided comprising a skeleton for supporting a soft flexible body mounted thereon. Soft flexible appendages such as the head and legs are joined directly to the skeleton by joining means interposed between the appendages and free ends of the skeleton. The joining means allow rotational movement of the appendages relative to the body within a limited range.

The improved doll of this invention possesses the advantage of rugged and reliable joining means for joining soft flexible appendages to the skeleton supported, soft flexible body. An advantage of having the joining means connected to the skeleton rather than directly to the soft body is to provide a completely soft and flexible doll having dependable, rugged, loose jointed appendages. Another advantage is to allow covering the body with under garments which are separate from and unaffected by movement of the appendages relative to the body.

In a further aspect of the invention, the joining means comprises a rigid ball on one of the appendage and skeleton, and a rigid socket member on the other of the appendage and skeleton. The socket member has an inner arcuate surface for slideably receiving the complementary outer peripheral surface of the ball. The outer and inner surfaces of the ball and socket respectively have a cooperating projection and slot for limiting the rotational movement of the appendage relative to the skeleton within a predetermined range. An advantage of this latter feature is to enable the appendages to be moved with a "floppy" or loose jointed motion. Another advantage of this latter feature is to provide a positive stop for holding the doll in a sitting position without applying any appreciable load on the ball and socket.

The ball of the joining means is hollow, and formed from a pair of mating, substantially hemispherical ball segments. The advantage of this is to provide a ball that can be economically formed in a simple molding operation.

When the joining means comprises a neck joint for joining the head to the skeleton, recesses along adjacent edges of the ball segments cooperate to define a keyhole shaped slot or opening having an enlarged end and a narrow end. The advantage of the enlarged end of the opening is to allow rotational floppy movement of the socket member and projection within a limited range defined by the edges of the opening. The projection is wider than the narrow end of the opening and cooperates with the narrow end when moved therein to expand the ball segments into frictional braking engagement with the inner surface of the socket member. This serves to lock the socket member in a fixed position. The advantage of this feature is to allow the head to be held in a fixed "heads up" position for posing or the like.

The joining means further comprises a ball retaining ring secured to the socket member. The retaining ring has an inner retainer surface complementary to and in engagement with the outer surface of the ball. The advantage of the retaining ring is to retain the socket member in engagement with the ball. The retainer may be hingedly connected to the socket member or separate therefrom.

More specifically, the skeleton comprises a rigid substantially inverted Y-shaped member having a backbone and a pair of hips. The backbone and hips are of cross-shaped cross section. The backbone has spaced apart slits on opposite sides to make it flexible in one plane. An advantage of this feature is to allow forward or bowing movement of the doll body, and rearward movement thereof.

A soft flexible body encircles the skeleton and is supported thereby. The body is formed from a soft rubber or plastic foam material. The body is provided with an undershirt to which a pair of flexible arms are secured. An advantage of this doll body construction is to provide soft flexible appendages such as the head and legs joined by rigid means to a soft flexible body. Also, since the joining means is connected directly to the skeleton rather than to the body, it resists being torn apart. Furthermore any clothing secured to the body is not affected by movement of the appendages.

BRIEF DESCRIPTION OF DRAWINGS

The details of my invention will be described in connection with the accompanying drawings, in which.

BEST MODE FOR CARRYING OUT THE INVENTION

Figure 1:
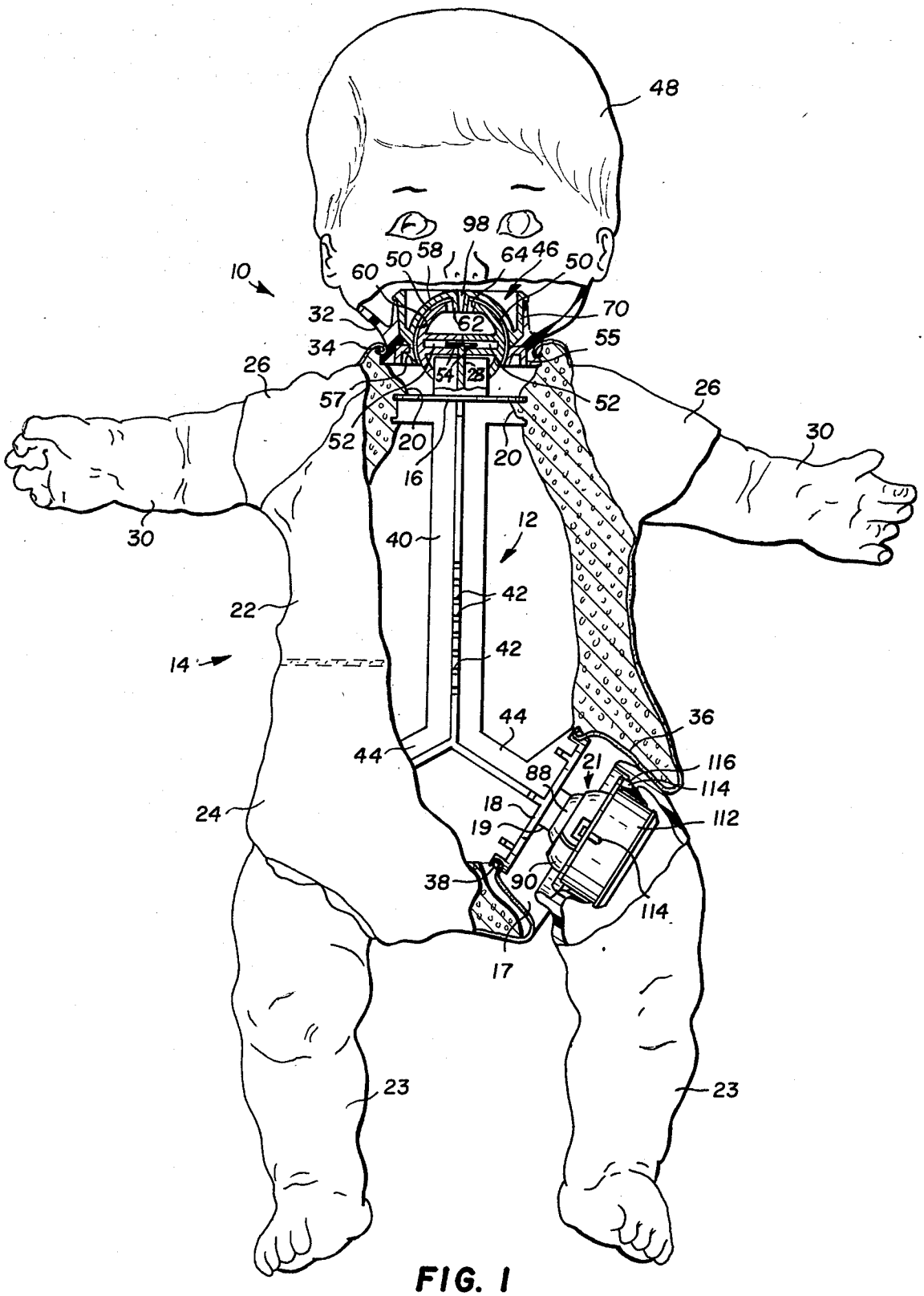
FIG. 1 is a side elevational view of the doll of this invention with portions thereof broken away and other portions sectioned.
Figure 2:
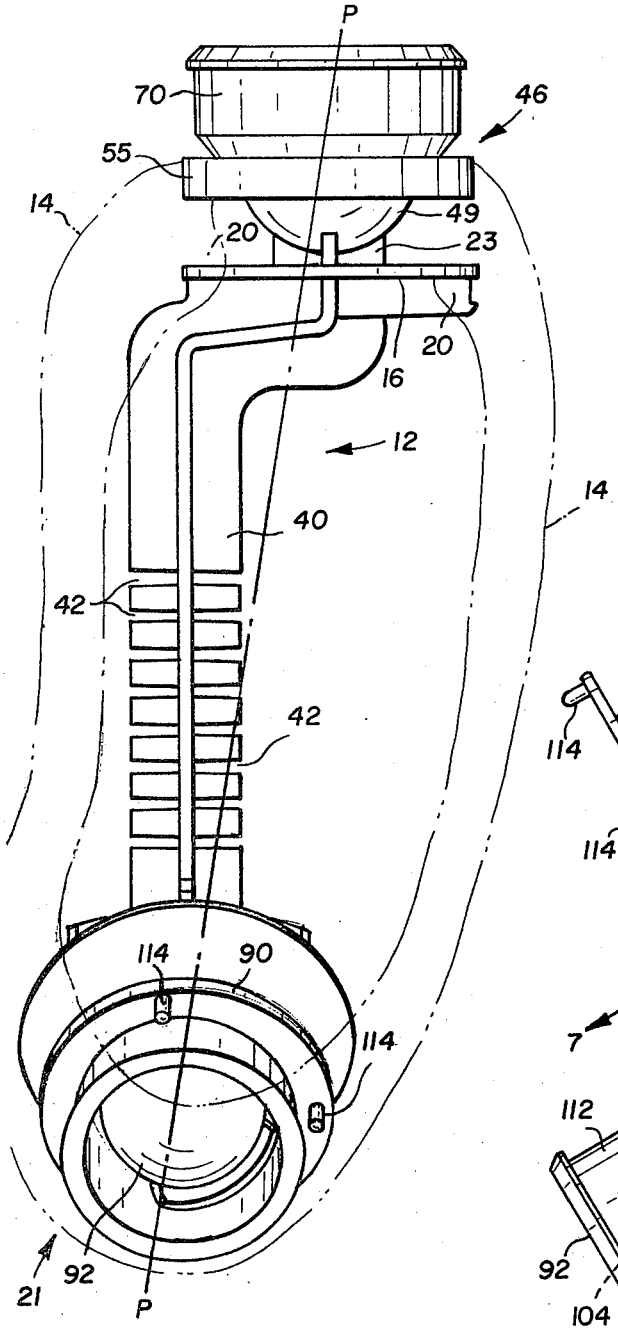
FIG. 2 is a side elevational view of the skeleton of the doll with sectioned portions of the body supported thereby illustrated by broken lines.

Referring to FIGS. 1 and 2 of the drawings, a doll 10 constructed in accordance with a preferred embodiment of this invention comprises a rigid frame or skeleton 12 for supporting a soft body 14 formed from a soft flexible material such as sponge rubber. The body 14 is formed from two molded half sections connected to neck and hip plates 16, 18 respectively on the skeleton along a canted parting line P—P. The upper ends of the body sections have projecting ribs 20 engaging opposite sides of neck plate 16 to assist in properly positioning the body sections on skeleton 12. The lower ends of the body sections encircle a pair of hip plates 18, only one of which is shown in FIG. 1, and extend therefrom to form cavities 17 into which hip posts 19 extend. Each hip post is connected by a hip joint 21 to the open end of a leg 23, all of which are recessed within cavity 17.

The doll body 14 is clothed in an undergarment comprising a shirt 22 and pants 24. The shirt 22 has short sleeves 26 which are filled with a soft resilient filler material, not shown, such as cotton fleece or the like. One end of each sleeve 26 is secured to an arm 30 formed out of flexible rubber, and the opposite end is secured to shirt 22. The neck portion of shirt 22 is preferably hemmed, and is secured to the outer periphery of the doll neck 32 by a tie-grip 34. The pants 24 have short pant legs 36, the hemmed ends of which are turned inwardly or reversed on themselves and pressed into the leg openings in body 14 and slipped over hip plates 18 and secured thereto by tie-grips 38. The body sections are secured together along the canted parting line P—P by any suitable adhesive or the like. The upper and lower ends of shirt 22 and pants 24 respectively are hemmed, and the hemmed ends secured together to completely enclose the body and complete the garment.

The skeleton 12 comprises an inverted Y-shaped member formed out of any suitable rigid plastic. The Y-shaped member has a cross-shaped cross section, and an L-shaped backbone 40 terminating in neck plate 16 and post 28. The backbone 40 has slots 42 on opposite sides thereof to allow limited angular movement of the backbone in one plane of motion. The doll body 14 is mounted on skeleton 12 such that the doll can be moved, due to flexible backbone 40, in a forward or "bowing" direction and in a rearward direction. The skeleton 12 further has a pair of hips 44 terminating in the hip plates 18 and posts 19.

Figure 3:
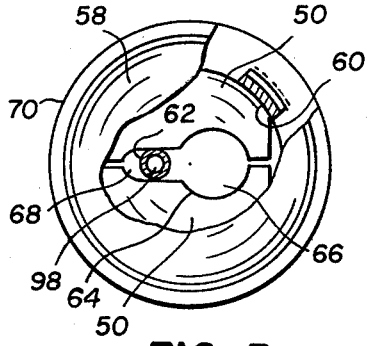
FIG. 3 is a top plan view of the skeleton of FIG. 2 with portions thereof broken away and sectioned.

With reference to FIGS. 1–3, a neck joint 46 is shown for joining a hollow doll head 48 formed from soft flexible rubber to neck post 28 of the doll body 14. The neck joint 46 comprises a ball 49 formed from a pair of hollow hemispherical ball segments 50 which may be hinged together by a living hinge, not shown, along a common edge. The ball segments 50 have internal grooves 52 for receiving complementary flanges 54 on neck post 28. The grooves and flanges are arranged or designed such that the ball segments can be mounted on the neck post in the proper orientation to form ball 49.

A socket member 58 has an inner socket surface 60 complementary to and encircling ball 49. The socket member 58 is retained in rotational engagement with ball 49 by a retaining ring 52 slideable on post 28 and having an inner surface complementary to the outer surface of ball 49. The retaining ring 55 is secured to socket member 58 for retaining the socket member in slideable engagement with ball 49. The securement is achieved by resilient fingers 57 on the socket member extending through notches in the retaining ring causing shoulders on the fingers and ring to interengage.

The socket member 58 further has a projection 62 depending from socket surface 60. The projection 62 extends into a key-hole shaped slot or opening 64 formed by adjacent cooperating edge recesses in ball segments 50. The large end 66 of opening 64 is substantially larger than projection 62 thereby allowing limited rotational and relatively free floppy movement of socket member 58 and head 48 relative to skeleton 12 and body 14. The width of projection 62 is slightly larger than the width of the small or narrow end 68 of opening 64. Accordingly, upright or rearward movement of head 48 causes projection 62 to slide into narrow end 68 of opening 64 forcing ball segments 50 apart into tight frictional braking engagement with socket surface 60, as best seen in FIG. 3. In this position, head 48 is rigid relative to body 14 so that the doll 10 may be posed, for example.

The socket member 58 further has a circular rim 70 for receiving neck 32 of head 48. The rim 70 and neck 32 have keying means such as interengaging ribs and notches, not shown, to insure proper orientation or positioning of the head on the doll.

With reference to FIGS. 1 and 4–7, the hip joints 21 are disclosed for joining hollow legs 23 formed from soft flexible rubber to hip posts 19 of skeleton 12. The skeleton has a pair of hollow hemispherical ball segments 80 extending from each hip post 19 and molded in a single operation. The ball segments 80 are preferably joined by a living hinge 82 along a common edge. The other edges of ball segments 80 are provided with latch parts 84, 86 which coact when the ball segments are folded over to releasably hold the ball segments together to form a ball 88.

Figure 4:
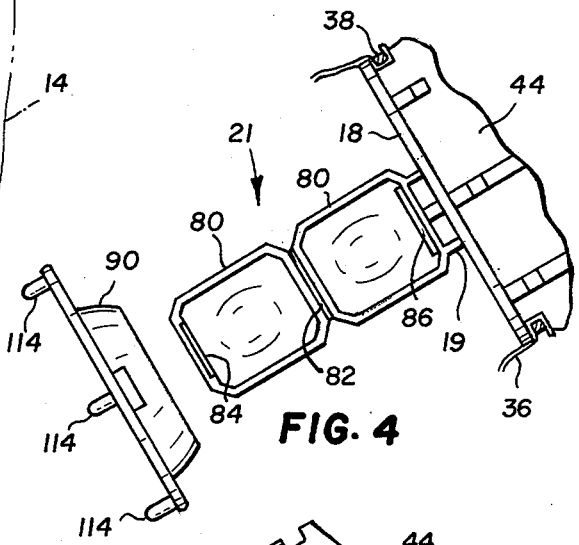
FIG. 4 is a segmental exploded view of a portion of one of the hip joints prior to its assembly.
Figure 5:
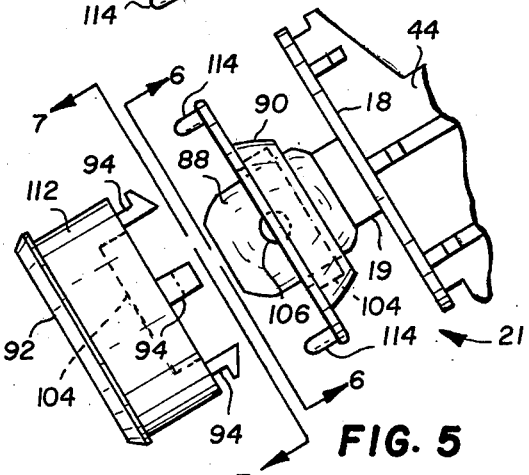
FIG. 5 is a view similar to FIG. 4 showing the assembled ball and ball retainer, and a socket member in position to be assembled.

With regard to each hip joint 21, prior to latching ball segments 80 to form ball 88, an annular retaining ring 90 is slipped over ball segments 80 as indicated by the arrow in FIG. 4. Retaining ring 90 has an inner surface 102 complementary to the outer periphery of ball 88. The ball segments 80 are latched together, and a socket member 92 having an inner surface 93 complementary to the outer surface of ball 88 is mounted on the ball and secured to retaining ring 90. This is achieved by resilient fingers 94 on socket member 92 (FIG. 5) extending through notches 96 (FIG. 6) in retaining ring 90 causing shoulders on the fingers and retaining ring to interengage for releasably holding the parts together.

The adjacent inner surfaces 93, 102 of socket member 92 and retaining ring 90 respectively have a rectangular groove or slot 104 (FIGS. 6 and 7) formed therein along the matching edges of the member and ring for receiving a radially extending nipple 106 (FIGS. 5 and 6) on ball 88. The side and end edges 108, 110 respectively of each slot 104 form stops for limiting the relatively free rotational movement of socket member 92 relative to ball 88. The socket member 92 has an outer circular rim or flange 112 for receiving the open end of leg 23. The flange 112 and leg 23 are keyed to one another by means of interengaging lugs 114 and notches 116 so that they can be secured together in the proper orientation. In the manner keyed, when both legs 23 are bent for placing the doll 10 in a sitting position, the nipples 106 engage one of the end edges 110 of the slots 104. In this sitting position, the doll body 14 leans slightly forwardly, and the weight of the doll tends to move the doll body in a forward direction holding the nipples 106 in positive engagement with the end edges 110 of slots 104. When the doll is raised, the legs 23 flop downwardly under the influence of gravity into a hanging position. During this latter movement, nipples 106 disengage end edges 110 and freely move along slots 104.

Figure 6:
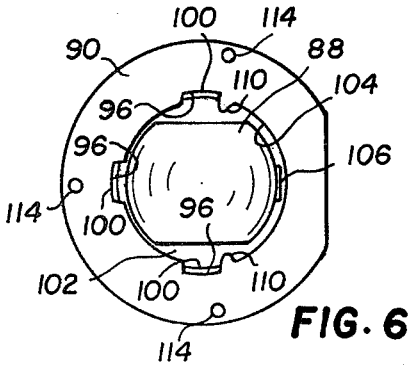
FIG. 6 is an elevational view taken substantially from line 6—6 of FIG. 5.
Figure 7:
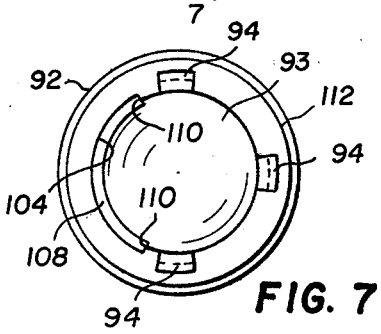
FIG. 7 is an elevational view taken substantially from line 7—7 of FIG. 5.

The neck socket member 58 has a central opening 98 extending therethrough (FIGS. 1 and 3) to allow air to escape during the assembling operation. Alternatively, openings 100 can be provided extending through socket members 58, 92 adjacent each finger 57, 94 through which air can escape as best seen in FIG. 6.

The invention has been described in detail with particular reference to preferred embodiments, but it will be understood that variations and modifications can be effected within the spirit and scope of the invention as described.

We claim:

1. An articulated doll comprising:

a skeleton having at least one terminal end;

a body mounted on the skeleton and supported thereby;

an appendage separate from the body and coupled to the skeleton; and means interposed between the appendage and the terminal end of the skeleton for joining the appendage directly to the terminal end for rotational movement of the appendage relative to the skeleton and body.

2. The articulated doll of claim 1 wherein the joining means comprises a ball on one of the appendage and skeleton, a socket member on the other of the appendage and skeleton, the socket member having an arcuate surface for slideably receiving the outer surface of the ball, a projection extending from one of the arcuate and outer surfaces of the socket member and ball respectively, and a slot in the other of the arcuate and outer surfaces for receiving the projection, the slot having end and side shoulders engageable by the projection for limiting rotational movement of the appendage relative to the skeleton.

3. The articulated doll of claim 2 wherein the slot is a key-hole shaped slot.

4. The articulated doll of claim 2 wherein the ball is hollow and formed from a pair of mating, substantially hemispherical ball segments, the projection extends radially inwardly from the arcuate surface of the socket member, and the slot is a key-hole shaped slot in the ball segments having an enlarged end and a narrow end in which the enlarged end allows rotational movement of the socket member, and the projection is wider than the narrow end and cooperates with the narrow end when the projection is moved therein to expand the ball segments into frictional engagement with the socket member for locking the socket member and appendage in a fixed position.

5. The articulated doll of claim 1 wherein the body encircles the skeleton and is formed from a soft flexible rubber or plastic foam material.

6. The articulated doll of claim 5 wherein the body comprises two molded half sections, each section having one end connected to one end of the skeleton and the opposite end connected to the opposite end of the skeleton.

7. A ball joint for securing a body appendage to a frame for limited rotational movement comprising:

a ball on one of the appendage and frame;

a socket member on the other of the appendage and frame and having an inner arcuate surface for slideably receiving the outer surface of the ball;

a ball retaining ring secured to the socket member and having a retaining surface complementary to and in engagement with the outer surface of the ball for retaining the ball between the socket member and retaining ring;

a projection extending from one of the arcuate and outer surfaces of the socket member and ball respectively and a slot in the other of the arcuate and outer surfaces for receiving the projection, the slot having end and side shoulders positively engageable by the projection for limiting rotational movement of the appendage relative to the frame.

8. The ball joint of claim 7 wherein the slot is a key-hole shaped slot.

9. The ball joint of claim 7 wherein the ball is hollow, and formed by a pair of mating substantially hemispherical ball segments, the projection extends from the inner arcuate surface of the socket member, and the slot is a key-hole shaped slot extending through the ball segments in which the enlarged end allows limited lateral movement and the narrow end allows rotational movement in one plane.

10. The ball joint of claim 9 wherein the width of the projection exceeds the width of the narrow end whereby movement of the projection into and along the narrow end causes the ball segments to be expanded into frictional braking engagement with the socket member for holding the appendage in a fixed position.

11. The ball joint of claim 7 wherein the frame is plastic, and has a pair of molded substantially hemispherical ball segments hinged together along a common side, the ball segments have latch means on the opposite sides adapted to cooperate when the ball segments are folded on the hinge causing the opposite sides to latch forming the ball.

12. The ball joint of claim 7 wherein the frame comprises a rigid substantially inverted Y-shaped skeleton including a backbone and two hips, and body appendages are secured by a neck joint to the free end of the backbone, and by hip joints to free ends of the hips.

13. The ball joint of claim 12 wherein the backbone is flexible in one plane of movement.

14. The ball joint according to claim 7 wherein the socket member has an outer socket surface, and an opening extends from the outer socket surface to the inner socket surface through which air can escape when the ball joint is assembled.

15. The ball joint according to claim 14 wherein latch means are provided for securing the ball retaining ring to the socket member, and the opening is formed as a part of and during the molding of the latch means.

16. An articulated doll comprising:

a skeleton;

a body mounted on the skeleton and supported thereby; an appendage; and means interposed between the appendage and skeleton for joining the appendage directly to the skeleton for rotational movement relative to the skeleton and body, the joining means comprising a ball on one of the appendage and skeleton, a socket member on the other of the appendage and skeleton, the socket member having an arcuate surface for slidably receiving the outer surface of the ball, a projection extending from one of the arcuate and outer surfaces of the socket member and ball respectively, a slot in the other of the arcuate and outer surfaces for receiving the projection, the slot having end and side shoulders engageable by the projection for limiting rotational movement of the appendage relative to the skeleton, and a ball retaining ring secured to the socket member and having a retaining surface complementary to and in engagement with the outer surface of the ball for retaining the ball between the socket member and retaining ring.

17. An articulated doll comprising:

a rigid, substantially inverted, Y-shaped skeleton having a backbone flexible in one plane and a pair of hips;

a body formed from a soft flexible rubber or plastic foam material mounted on and encircling the skeleton and supported thereby with free ends of the backbone and hips extending from the body, a shirt covering the upper end of the body and a pair of flexible arms secured to the shirt;

a plurality of appendages comprising a head and a pair of legs; and means comprising a neck joint for directly connecting the head to the free end of the backbone for rotational movement, and a pair of hip joints wherein each of the hip joints directly connects one of the legs to the free end of a complementary hip for rotational movement.

18. The articulated doll of claim 17 wherein the neck joint for joining the head to the free end of the backbone comprises a ball on the free end of the backbone, a socket member on the head having an arcuate surface for slideably receiving the outer surface of the ball, a ball retaining ring for retaining the ball between the socket member and retaining ring, a projection extending from the arcuate surface of the socket member, and a slot in the outer surface of the ball for receiving the projection, the slot having shoulders engageable by the projection for limiting rotational movement of the head relative to the backbone and body.

19. The articulated doll of claim 18 wherein the ball is hollow and formed from a pair of mating substantially hemispherical ball segments, the projection extends radially inwardly from the arcuate surface of the socket member, and the slot is a key-hole shaped slot extending through the ball segments and having an enlarged end and a narrow end in which the enlarged end allows substantially free rotational movement of the head, and the projection is wider than the narrow end and cooperates with the narrow end when the projection is moved therein to expand the ball segments into frictional engagement with the socket member for locking the head in a fixed position.

20. The articulated doll of claim 17 wherein the hip joint for joining each leg to a hip of the skeleton comprises a ball on the hip, a socket member on the leg having an arcuate surface for slideably receiving the outer surface of the ball, a ball retaining ring for retaining the ball between the socket member and retaining ring, and a projection extending radially outwardly from the outer surface of the ball, and a slot in the arcuate surface for receiving the projection, the slot having end and side shoulders engageable by the projection for limiting rotational movement of the leg relative to the skeleton.

21. The articulated doll of claim 20 wherein keying means are provided on the socket member and leg for positioning the end shoulders and projection such that when the legs are moved to a sitting position, the weight of the body urges each projection into positive engagement with one of the end shoulders for holding the doll in a sitting position.

22. The articulated doll of claim 17, and further having a stationary plate secured to each hip adjacent the ball, and pants covering the lower end of the body, the pants having one part connected to the lower end of the shirt and a pair of pant legs, each pant leg having its free end reversed on itself and connected to a plate on one side of and separate from the hip joint and leg.

* * * * *